United States Patent [19]

Bucefari et al.

[11] Patent Number: 4,932,203

[45] Date of Patent: Jun. 12, 1990

[54] MACHINE FOR THE PRODUCTION OF "BOW-TYPE" ORNAMENTAL CHAINS

[75] Inventors: Massimo Bucefari; Corrado Lapini; Michele Lazzarini, all of Arezzo, Italy

[73] Assignee: C.M.S.S.P.A. Costruzione Macchine Speciali, Arezza, Italy

[21] Appl. No.: 301,378

[22] Filed: Jan. 25, 1989

[30] Foreign Application Priority Data

Jan. 29, 1988 [IT] Italy ..... 9319 A/88

[51] Int. Cl.[5] ..... B21L 7/00

[52] U.S. Cl. ..... 59/16; 59/20; 59/23; 59/25

[58] Field of Search ..... 59/7, 16, 18, 17, 20, 59/22, 23, 24, 25

[56] References Cited

U.S. PATENT DOCUMENTS

| | | | |
|---|---|---|---|
| 4,127,987 | 12/1978 | Tega et al. | 59/16 |
| 4,175,379 | 11/1979 | Tega | 59/16 |
| 4,311,003 | 1/1982 | Tega | 59/16 |
| 4,503,664 | 3/1985 | Allazzetta et al. | 59/16 |
| 4,548,031 | 10/1985 | Massimo et al. | 59/16 |

FOREIGN PATENT DOCUMENTS

| | | | |
|---|---|---|---|
| 526621 | 5/1931 | Fed. Rep. of Germany | 59/17 |
| 2804310 | 2/1978 | Fed. Rep. of Germany | 59/16 |
| 11932B/85 | 12/1985 | Italy . | |

*Primary Examiner*—David Jones

*Attorney, Agent, or Firm*—Browdy and Neimark

[57] ABSTRACT

A machine for the production of an ornamental chain known as "bow-type" chain, the chain consisting of a sequence of large links, twisted in a figure-of-eight shape and incorporating a smaller link, linked together by smaller links. The machine comprises a first and a second station for forming and linking the small links and the large links and a transportation gripper which, beside transferring the chain in formation from one station to the other one, takes part in the formation of the links in both stations. An auxiliary gripper is provided which is integral with the transportation gripper, for the positioning of the smaller link on the large link, while the latter is twisted to incorporate the small link. Two small links for every large link are produced in the respective stations and, during the production of the small links to be incorporated in the large links, the large link production station is temporarily stopped.

3 Claims, 4 Drawing Sheets

MACHINE FOR THE PRODUCTION OF "BOW-TYPE" ORNAMENTAL CHAINS

FIELD OF THE INVENTION

The present invention relates to a machine for the production of "bow-type" ornamental chains in the goldsmith's and trinkets industry.

STATUS OF THE ART

As is known, the outstanding feature of ornamental chains of the abovementioned type consists in the fact that its repetitive unitary module comprises a small link incorporated in a larger link twisted in a figure-of-eight shape. The production of this type of chain, which is at present performed manually, could in principle be automated using a machine for the production of chains with alternate links of the commercial type, such as that, for example, described in German Patent No. 2804310 or that described in U.S. Pat. No. 4,548,031, modifying the operating sequence thereof so as to enable incorporation of the small link in the large link, instead of linking them together. In other words, one of the two stations with which the machines of the abovementioned type are equipped could be used for forming the small link to be transferred by means of the transportation gripper to the other station where the large link is formed, in which large link the said small link is incorporated when the former is twisted into a figure-of-eight shape. It has been noted, however, that the chain thus obtained has a serious qualitative defect, namely the poor "fluidity" of the links, and hence if a link is out-of-line or displaced with respect to its normal position of alignment with the other links, the weight of the chain alone is not sufficient to overcome the forces which keep it in this anomalous position, with the consequent formation of unaesthetic kinks and irregularities along the chain.

In order to eliminate this defect, a modified configuration has been designed for the chain in question, according to which the twisted links incorporating the small link are connected to each other by means of a further small link. A "bow-type" chain thus modified, on the other hand, cannot be obtained by making simple modifications to the operating sequence of the machines for producing chains with alternate links, such as those mentioned above.

The object of the present invention, therefore, is to provide a machine for the production of "bow-type" ornamental chains having a modified configuration as described above so as to provide them with an adequate degree of "fluidity".

SUMMARY OF THE INVENTION

The machine according to the invention has a structure substantially similar to that of a machine for producing chains with alternate links, consisting of two stations for forming the small links and the large links and for linking them to the chain already formed, cooperating alternately, in order to form the links, with a movable transportation gripper for transferring the chain being formed from one station to the other and capable of performing an axial rotation of at least 180° so as to twist the large link into a figure-of-eight shape. The characteristic feature of the machine according to the invention consists in the fact that there is provided, rigidly fixed to the transportation gripper, auxiliary gripping means for removing a small link formed in the corresponding station, so as to transfer it to the other station and position it on the large link at the moment when the latter is twisted, so as to be incorporated in the latter. The machine therefore produces for each large link two small links which are alternately incorporated in and linked with the latter. The two stations are provided with independent operating means, making it possible to stop temporarily the station dealing with production of the large link so as to be able to support the chain being formed and enable the gripper to cooperate with the other station in forming the small link intended to be incorporated in the large link.

BRIEF DESCRIPTION OF THE DRAWINGS

Characteristic features and advantages of the machine for producing "bow-type" ornamental chains according to the invention will emerge more clearly from the description, which follows, of an embodiment thereof, given by way of non-limiting example with reference to the accompanying drawings in which.

DESCRIPTION OF A PREFERRED EMBODIMENT

Figure 1:
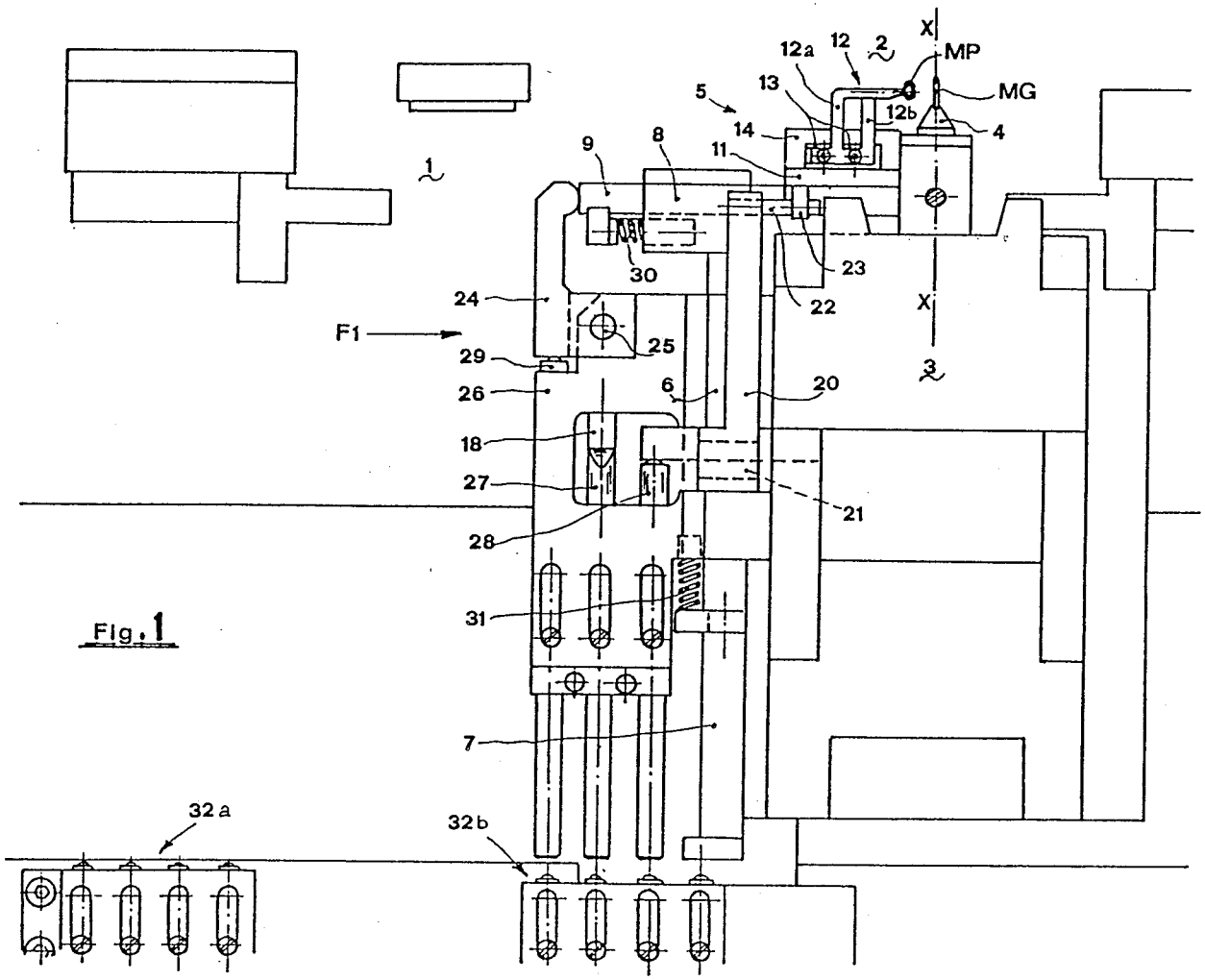
FIG. 1 is diagrammatic plan view of the machine according to the present invention.
Figure 2:
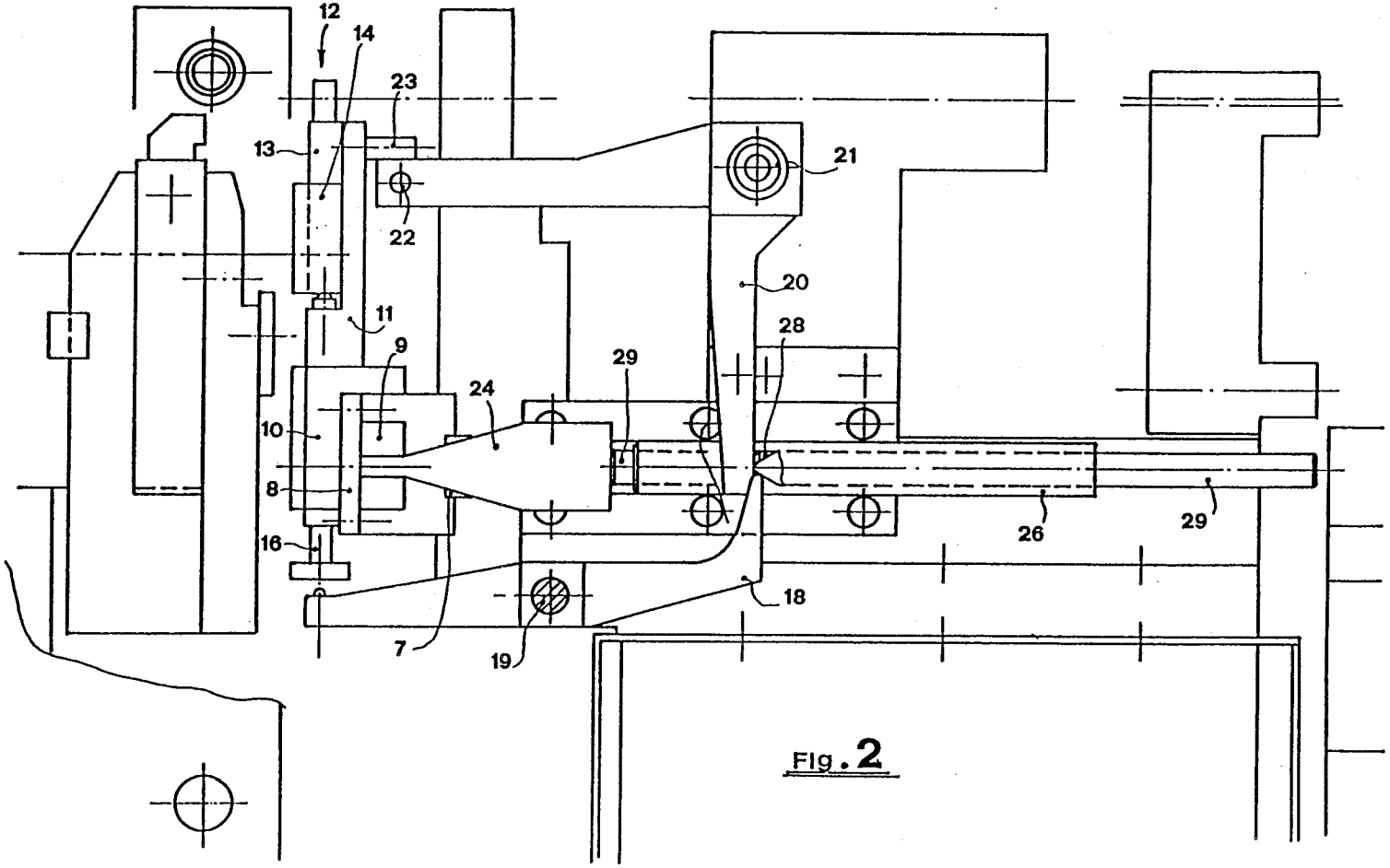
FIG. 2 is a side view of the machine shown in FIG. 1, in the direction of the arrow F1.
Figure 3:
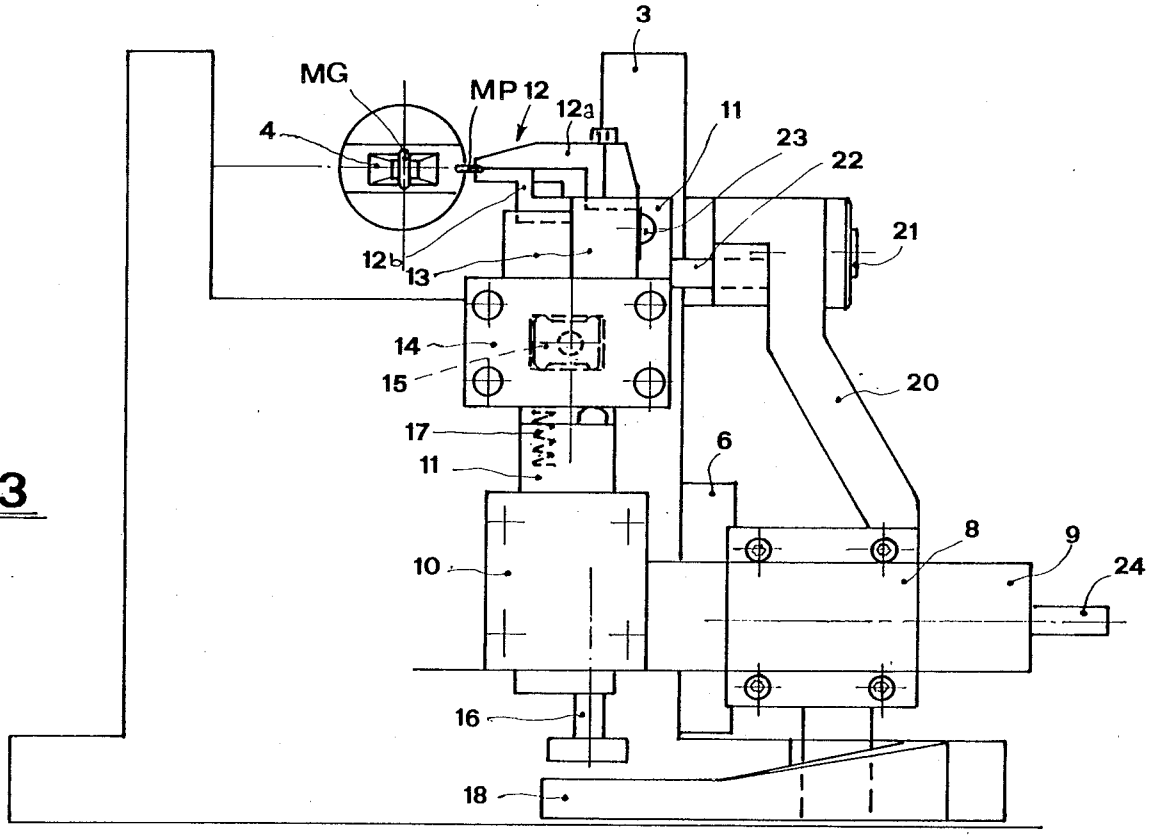
FIG. 3 is a side elevation view of the machine shown in FIG. 1, in the direction of the arrow F2.

With reference to FIG. 1, 1 and 2 denote generally the position of a first and a second station for forming small links and large links, respectively, and for linking them to the chain already formed. 3 denotes a unit for transporting the chain being formed, movable alternately from one station to the other and comprising a gripper 4, which in addition to supporting the chain being formed during transportation from one station to another, directly participates in the formation of the links in the two stations. The two stations and the gripper unit are already known per se as regards structure, operation and reciprocal cooperation, and for a detailed description thereof reference may be made to the abovementioned German and US patents. In each of the two stations, the individual links are produced from a spiral of wirelike material which may or may not be precious and from which the individual turns are obtained by means of cutting and which are shaped and closed by a shaping gripper cooperating with the transportation gripper.

With reference to FIGS. 1, 2 and 3, 5 denotes generally an auxiliary gripping unit integral with the gripper unit 3 in that it is supported, as will be explained below, by a support block fixed laterally to the gripper unit 3. The support block 6 has slidably mounted on it a first horizontal slide 7 parallel to the axis of the transportation gripper 4 (indicated by X—X in FIG. 1), which slide supports a first guide 8 inside which is slidably mounted, in turn, a second horizontal slide 9 perpendicular to the axis X—X of the gripper 4. The second slide 9 has at one end a second guide 10 inside which is vertically slidably mounted a third slide 11 at the top end of which there is arranged an auxiliary gripper 12 consisting of two cooperating arms **12*a* and 12*b*. The two arms 12*a* and 12*b* extend from two respective supports 13 sliding vertically inside a body 14** fixed to the third slide 11 and accomodating a lobed lever 15 which, acting on the supports 13, controls opening and closing of the auxiliary gripper 12. The lobed lever 15 is of the type illustrated, for example, in Italian Patent application No. 11932B/85, to which reference should be made for a more detailed description. It is obvious that equivalent means for actuating the auxiliary gripper 12 may be used by way of an alternative.

The lobed lever 15 is actuated by means of a tappet 16 sliding inside the third slide 11 and acting in opposition to a spring 17. The tappet 16 is operated by a first lever 18 hinged on a horizontal pin 19 integral with the support block 6. Raising and lowering of the gripper 12, i.e. vertical sliding of the third slide 11 inside the second guide 10, is obtained through the action of a second lever 20 hinged on a horizontal pin 21 which is integral with the support block 18 and from the end of which there extends a pin 22 which meets, on the surface, with a further pin 23 rigidly connected and projecting from the third slide 11. Movement of the auxiliary gripper 12 towards and away from the transportation gripper 4, i.e. sliding of the second slide 9 within the first guide 8, is obtained by means of a third lever 24 hinged on a vertical pin 25; the latter is integral with a block 26 supported by the support block 6 and slidably incorporating three horizontal tappets, denoted by 27, 28 and 29, which operate, respectively, the first lever 18 so as to open and close the auxiliary gripper 12, the second lever 20 so as to obtain vertical sliding, and the third lever 24 so as to obtain the movement towards and away from the transportation gripper 4. The first slide 7 and the second slide 9 are slidable in opposition to the springs 30 and 31, respectively.

The tappets 27, 28 and 29 and the first slide 7 are operated by two separate actuating units, denoted generally by 32*a* and 32*b*, which are located opposite the two stations and with which the said tappets and the said first slide are aligned in each particular case. The two actuating units 32*a* and 32*b* are in turn operated by motor means via cam shafts and rocker arms. The first and the second station 1 and 2 are also independently motor-driven, since the second station 2 for forming the large link must stop temporarily when the small link to be incorporated in the large link is produced in the first station 1. During this operation, in fact, the chain being formed remains suspended, in the second station 2, from the spiral from which the large link will be obtained, thus leaving the transportation gripper 4 free to cooperate in the formation of the small link in the first station 1.

Operation of the machine according to the present invention is as follows. First of all, a small link indicated by MP in FIG. 1, is formed in the first station 1 with the aid of the transportation gripper 4. The small link MP is then consigned to the auxiliary gripper 12. The transportation unit 3 moves towards the second station 2 where the small link MP is positioned inside the large link, indicated by MG, being formed in this station with the aid of the holding gripper 4. It should be noted that, during this stage, any chain formed previously is supended from the large link MG. In order to incorporate the small link MP in the large link MG, the gripper 4, which holds the large link MG on one side, performs an axial rotation of 180° so as to twist the latter into a figure-of-eight shape, trapping inside it the small link MP. In reality, the axial rotation of the gripper will be slightly greater than 180° so as to take into account the elastic recovery of the material and ensure that the small link MP is securely engaged inside the large link MG. The transportation unit 3 then moves towards the first station 1, taking with it the chain being formed, which chain is carried by the gripper 4 holding the large link which has just been twisted. The latter, in the first station 1, is engaged in the turn intended to form the next small joining link which is then formed with the aid of the gripper 4. The transportation unit 3 then moves again towards the second station 2, taking with it the chain being formed and engaging the small joining link MP just formed inside the turn intended to form the next large link. At this point, the second station 2 stops, with the chain being formed remaining suspended from the spiral, while the transportation unit 3, with the grippers 4 and 12 free, is transferred again opposite the first station 1 so as to form another small chain, repeating the sequence described hitherto.

Figure 4:
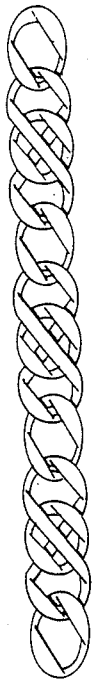
FIG. 4 shows a part of a bow-type chain produced using the machine according to the invention.

The ornamental chain produced using the machine according to the present invention and illustrated in FIG. 4, after welding of the links, may undergo further processing operations and treatment which may change, even substantially, the external appearance, while leaving its structure unchanged; it may, for example, undergo surface treatment consisting in hammering or diamond-setting, and, in addition to the links, various inserts such as small crosspieces and rings may be applied.

Variations and/or changes may be made to the machine for producing "bow-type" ornamental chains according to the present invention, without thereby going outside the protective scope of the invention itself.

We claim:

1. An apparatus for producing a "bow-type" ornamental chain on a machine used for production of chains with alternate links, the said chain consisting of a succession of alternate small links and large links, the said large links being twisted substantially into a figure-of-eight shape and incorporating a further small link, comprising:

a first and second station for forming the said small links and the said large links, respectively, and for linking them to the chain already formed;

a movable transportation gripper for transferring the chain being formed from one station to the other;

said transportation gripper having means for axial rotation of at least 180° when opposite the said second station so as to twist the said large link;

auxiliary gripping means, integral with the said transportation gripper, for removing a small link formed in the said first station, transferring it to the said second station and positioning it on the said large link at the moment when the latter is twisted;

wherein said small link is incorporated in the large link; and independent operating means for causing the said second station to stop temporarily in order to support the chain when the small link intended to be incorporated in the large link is formed in the said first station.

2. An apparatus according to claim 1, wherein said auxiliary gripping means comprises: a gripper able to perform translatory movements; in (1) a vertical direction; (2) in a direction towards and away from the said transportation gripper, and, (3) in a direction parallel to the axis of the said transportation gripper.

3. An apparatus according to claim 2, wherein the said auxiliary gripping means comprises:

a support block which is movable integrally with the said transportation gripper and to which there is slidably connected;

a first horizontal slide carrying a first guide inside which there is engaged;

a second horizontal slide carrying a second guide inside which there is engaged;

a third vertical slide carrying said auxiliary gripper; and respective levers and tappets operated by separate actuating units installed opposite the said first and second stations for causing sliding of the said slides, as well as opening and closing of the said auxiliary gripper.

* * * * *